United States Patent [19]

MacLean

[11] Patent Number: 4,466,479

[45] Date of Patent: Aug. 21, 1984

[54] METHOD OF TRANSFERRING HEAT BETWEEN TWO FLUIDS AND HEAT EXCHANGE TUBE

[75] Inventor: John P. MacLean, Houston, Tex.

[73] Assignee: Texaco Inc., White Plains, N.Y.

[21] Appl. No.: 409,390

[22] Filed: Aug. 19, 1982

[51] Int. Cl.[3] ..... F28C 3/16

[52] U.S. Cl. ..... 165/1; 165/104.16; 165/177; 165/183; 122/4 D; 122/367 R; 422/146

[58] Field of Search ..... 165/104.16, 177, 183, 165/DIG. 27, 1; 122/4 D, 367 R, 367 A, 367 C; 422/146

[56] References Cited

U.S. PATENT DOCUMENTS

| | | | |
|---|---|---|---|
| 1,841,722 | 1/1932 | Fest | 122/367 R X |
| 1,870,670 | 8/1932 | Brown | 122/367 R X |
| 2,185,929 | 1/1940 | Simpson et al. | 165/104.16 X |
| 3,416,487 | 12/1968 | Greene | 116/137 |
| 3,524,729 | 8/1970 | Markel et al. | 165/177 X |

FOREIGN PATENT DOCUMENTS

| | | | |
|---|---|---|---|
| 2927699 | 1/1981 | Fed. Rep. of Germany | 165/DIG. 27 |
| 806049 | 12/1958 | United Kingdom | 165/177 |
| 1147129 | 4/1969 | United Kingdom | 165/104.16 |
| 249403 | 1/1970 | U.S.S.R. | 165/183 |

OTHER PUBLICATIONS

Canadian Journal of Chemical Engineers, vol. 50, Feb. 1972, pp. 44–48.

Chemical Engineers' Handbook, R. H. Perry & C. H. Chilton, pp. 11–18.

*Primary Examiner*—Albert W. Davis, Jr.

*Attorney, Agent, or Firm*—Jack H. Park; Theron H. Nichols; Richard A. Morgan

[57] ABSTRACT

A method for transferring heat between two fluids comprises (1) flowing the first fluid in an upright diamond shaped tube, and (2) flowing the second fluid therearound the tube over upper and lower surfaces of the diamond shaped tube formed at an angle to the horizon that is greater than the angle of repose of the second fluid therearound the tube for preventing accumulation of second fluid sediment on top and stagnant gases on the bottom of the tube. A novel heat exchanger tube is also disclosed.

5 Claims, 2 Drawing Figures

METHOD OF TRANSFERRING HEAT BETWEEN TWO FLUIDS AND HEAT EXCHANGE TUBE

BACKGROUND OF THE INVENTION

Many studies and reports have been made for increasing the heat transfer from a horizontal tube to a fluid therearound as a fluidized bed. The authors report overall heat transfer coefficients of 35 BTU/hr °F. ft$^2$. They also report that values in the range of 80–120 BTU/hr °F. ft$^2$ are theoretically possible. Studies reveal the cause of the low coefficients to be a defluidized pile of catalyst on the top of the tube and a stagnant gas pocket on the bottom of the tube, both insulating the tube partially, as illustrated in FIG. 1 of the drawings.

The high coke yields expected from new proposed catalytic cracking of residue will require additional heat removal facilities from the regenerator for unit heat balance. The more heat required to be carried off, the number and size of coils are required to be increased.

Instead, it would be desirable to increase the efficiency of heal transfer through the heat exchanger tubes and thus decrease the number and size of heat exchanger coils. Also, it would be desirable to have heat transfer coefficient in the 100 BTU/hr °F. ft$^2$ range which would be three times that with the conventional circular cross-section.

OBJECTS OF THE INVENTION

Thus a principal object of this invention is to provide a more efficient method for transferring heat between a fluid flowing inside of a tube and a fluid flowing externally of the tube.

Another principal object of this invention is to provide a more efficient heat exchanger tube for exchanging heat between fluid flowing internally of a tube and fluid flowing around the tube.

A further object of this invention is to provide an efficient method of exchanging heat between two fluids and a heat transfer tube that is easy to operate, is of simple configuration, is economical to build and assemble, and is of greater efficiency for the transfer of heat between fluid flowing internally of a tube and fluid flowing around the tube.

Other objects and various advantages of the disclosed method of transferring heat between the two fluids and a heat exchanger will be apparent from the following detailed description, together with the accompanying drawings, submitted for purposes of illustration only and not intended to define the scope of the invention, reference being made for that purpose to the subjoined claims.

BRIEF DESCRIPTION OF THE DRAWINGS

The drawings diagrammatically illustrate by way of example, not by way of limitation, one form of the invention wherein like reference numerals designate corresponding parts in several views in which.

Figure 1:
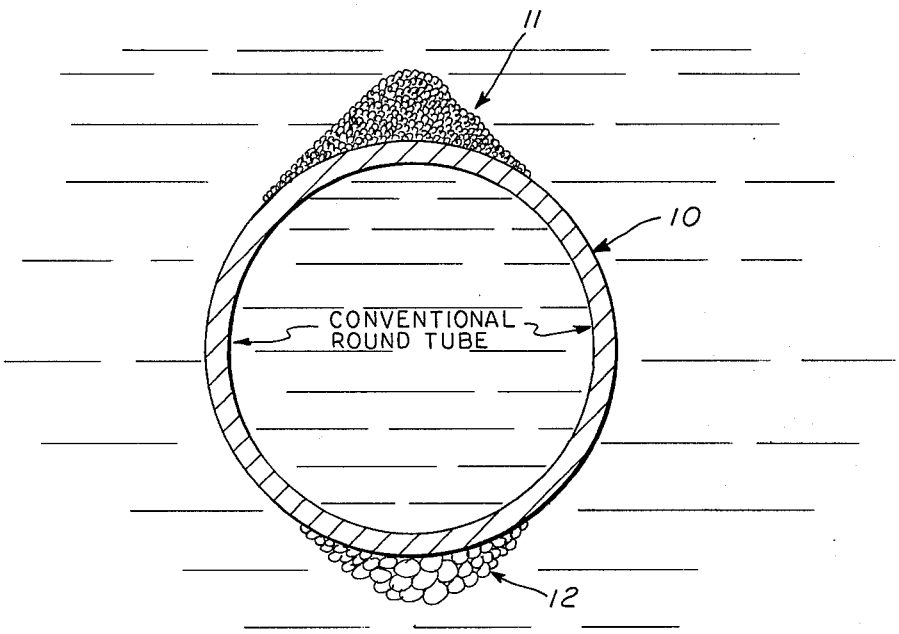
fig. 1 (PRIOR ART)
FIG. 1 is a schematic diagrammatic vertical sectional view of the conventional heat exchanging tube.

The invention disclosed herein, the scope of which being defined in the appended claims is not limited in its application to the details of construction and arrangement of parts shown and described, since the invention is capable of being in the form of other embodiments and of being practiced or carried out in various other ways. Also, it is to be understood that the phraseology or terminology employed here is for the purpose of description and not of imitation. Further, many modifications and variations of the invention as hereinafter set forth will occur to those skilled in the art. Therefore, all such modifications and variations which are within the spirit and scope of the invention herein are included and only such limitations shoud be imposed as are indicated in the appended claims.

DESCRIPTION OF THE INVENTION

Two related embodiments of my invention are disclosed herein, a method for efficiently transferring heat between a fluid flowing internally of a tube and fluid flowing externally of the tube, and a mechanism for practicing the above method comprising a diamond shaped tube.

The new basic method for efficiently transferring heat between one fluid flowing internally of a tube and a second fluid flowing around the tube comprises the following two steps:

(1) flowing the first fluid in an upright diamond shaped tube, and (2) flowing the second fluid therearound the tube over upper and lower surfaces of the diamond shaped tube formed at an angle to the horizon that is greater than the angle of repose of the second fluid therearound the tube for preventing accumulation of second fluid sediment on top and stagnant gases on the bottom of the tube.

A more detailed method for transferring heat between a first fluid in a tube in a catalyst regenerator of a fluidized catalyst cracking unit and another fluid comprising the fluidized bed in the catalyst regenerator surrounding the tube comprising the steps of:

(1) flowing the first fluid through an upright diamond shaped tube, and (2) flowing the fluidized bed fluid around the upper and lower surfaces of the diamond shaped tube formed at an angle to the horizon that is greater than the angle of repose of the fluidized bed fluid for preventing accumulation of sediment from the fluidized bed fluid on top and stagnant gases on the bottom of the diamond shaped tube.

The new and unexpected results of the above methods is a heat transfer coefficient in the 100 BTU/hr °F. ft$^2$ range, which is about three times that with the conventional circular cross-section.

THE PREFERRED EMBODIMENT FOR PRACTICING THE INVENTION

The above methods for transferring heat from a fluid flowing in a tube and fluid flowing around the tube may be performed by other mechanisms than that disclosed in the FIGURES. The mechanism disclosed herein may be operated by other methods than those disclosed, as by hand. Also the disclosed mechanism can be used to practice another and materially different method. However, the preferred device for performing the method is disclosed in FIG. 2 of the drawings.

FIG. 1 illustrates the conventional circular heat exchanger tube 10 wherein the residue or sediment 11 has settled on top of the tube and gas bubbles 12 are trapped or have lodged up against the bottom of the tube. As is well known in the literature, below the round tube there is a film or cushion of air of variable thickness, and above the round tubes there is little particle movement and the region is apparently defluidized, often referred to as the "defluidized cap". Both of these foreign materials, the sediment and the gas bubbles radically change the coefficient of heat for those areas of the tube covered. Reports have shown that heat transfer coefficients 35 BTU/hr °F. ft$^2$ result from the above conventional heat exchanger tube of FIG. 1.

Figure 2:
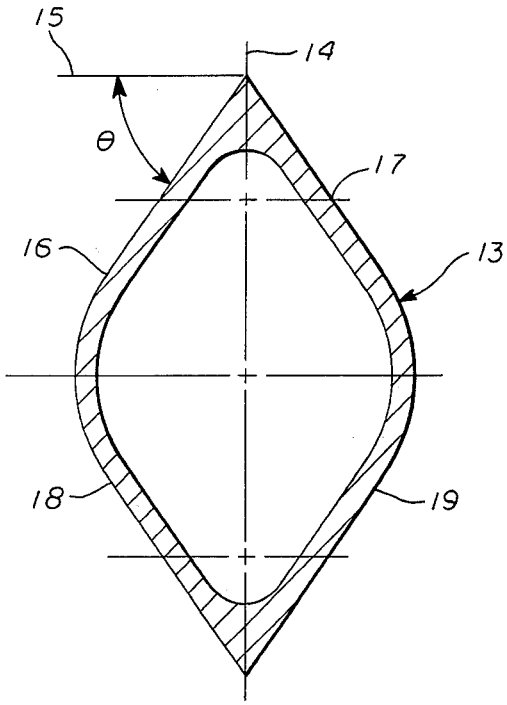
FIG. 2 is a schematic diagrammatic vertical sectional view of the new diamond shaped heat transfer tube.

FIG. 2 discloses the new diamond shaped heat exchanger tube 13 with the long axis or center line 14 being vertical. The angle $\theta$ illustrated between the horizon 15 and one of the upper surfaces 16 of the tube 13 is equal to the angle of repose of the particular settled particles making up the fluidized bed in which the tube is to be submerged plus a few degrees, as 5° for example, to insure that all material slides off and does not stick to the tube upper surface. The other upper surface 17 is similar to upper surface 16.

The lower surfaces 18, 19 of the diamond shaped heat exchanger tube may be the allochiral analogue of the upper surfaces 16, 17, respectively. Thus the tube is reversible as to its alignment on its vertical axis connecting the most widely spaced apart points of the diamond. Further, with the angle of the upper surfaces of each diamond shaped heat exchanger tube being greater than the angle of repose of the fluid that it is designed for operating in, this angle is deemed to always be great enough, when used as the lower surface angles, to permit free upward flow of all gas bubbles past the diamond shaped heat exchanger tube with no piling up as on the prior art of FIG. 1. Accordingly, bubble entrapment is precluded.

The internal radius R of each of the two thickest ends on the center line 14 are each made as short as possible consistent with safety structural requirements of the tube. The tube is symmetrical about both horizontal 20 and vertical 14 axis, as illustrated.

Engineering studies indicate that the new and unexpected results of the above described heat exchanger are the high heat transfer coefficients in the 100 BTU/hr °F. ft$^2$ range for this heat exchange tube as compared to 35 BTU/hr °F. ft$^2$ for the conventional circular cross-sectional heat exchanger tubes presently being used.

Accordingly, it will be seen that the disclosed method for efficiently transferring heat and the disclosed heat exchanger tube will operate in a manner which meets each of the objects set forth hereinbefore.

While only one method of the invention and one mechanism for carrying out the method have been disclosed, it will be evident that various other methods and modifications are possible in the disclosed method for transferring heat between two fluids and the arrangement and construction of the disclosed heat exchanger tube without departing from the scope of the invention, and it is accordingly desired to comprehend within the purview of this invention such modifications as may be considered to fall within the scope of the appended claims.

I claim:

1. A method for efficiently transferring heat between a first fluid in a tube and a second fluid in the form of a fluidized bed around the tube comprising the steps of, (a) moving the first fluid through an upright diamond shaped tube, and (b) moving the fluidized bed fluid therearound the upper and lower surfaces of the diamond shaped tube formed at an angle to the horizon that is greater than the angle of repose of the fluidized bed fluid for preventing accumulation of sediment from the fluidized bed fluid on top and stagnant gases on the bottom of the diamond shaped tube.

2. A method for efficiently transferring heat between a first fluid in a tube in a catalyst regenerator of a fluidized catalytic cracking unit and another fluid comprising the fluidized bed in the catalyst regenerator surrounding the tube comprising the steps of, (a) passing the first fluid through an upright diamond shaped tube, (b) passing the fluidized bed fluid around the upper and lower surfaces of the diamond shaped tube formed at an angle to the horizon that is greater than the angle of repose of the fluidized bed fluid for preventing accumulation of sediment from the fluidized bed fluid on top and stagnant gases on the bottom of the diamond shaped tube.

3. A method for efficiently transferring heat between a first fluid in a tube in a catalyst regenerator of a fluidized catalytic cracking unit and another fluid comprising the fluidized bed in the catalyst regenerator surrounding the tube comprising the steps of, (a) passing the first fluid through an upright diamond shaped tube, (b) passing the fluidized bed fluid around the upper and lower surfaces of the diamond shaped tube formed at an angle to the horizon that is greater than the angle of repose of settling particles making up the fluidized bed in which the diamond shaped tube is submerged for preventing accumulation of sediment from the fluidized bed fluid on top and stagnant gases on the bottom of the diamond shaped tube.

4. The method of claim 3 wherein the angle formed between the upper and lower surfaces of the diamond shaped tube and the horizon is equal to the angle of repose of settling particles making up the fluidized bed in which the tube is submerged plus a few degrees.

5. The method of claim 4 wherein the number of degrees is 5.

* * * * *